US008556107B2

(12) United States Patent
McRobbie et al.

(10) Patent No.: US 8,556,107 B2
(45) **Date of Patent: *Oct. 15, 2013**

(54) BIOCONTAINER SYSTEM

(75) Inventors: Gary Douglas McRobbie, Hants (GB); Darren George Elton, Southampton (GB)

(73) Assignee: Pall Corporation, Port Washington, NY (US)

( * ) Notice: Subject to any disclaimer, the term of this patent is extended or adjusted under 35 U.S.C. 154(b) by 408 days.

This patent is subject to a terminal disclaimer.

(21) Appl. No.: 12/406,990

(22) Filed: Mar. 19, 2009

(65) Prior Publication Data

US 2009/0236344 A1 Sep. 24, 2009

(30) Foreign Application Priority Data

Mar. 22, 2008 (EP) ..... 08005404

(51) Int. Cl.
*B65D 25/14* (2006.01)

(52) U.S. Cl.
USPC ..... 220/495.06

(58) Field of Classification Search
USPC ..... 220/23.91, 495.06, 403, 650, 62.21, 220/495.05, 628, 630, 636; 366/136, 137; 206/511, 503, 509; 383/66; 222/105; 248/96, 65
See application file for complete search history.

(56) References Cited

U.S. PATENT DOCUMENTS 5,402,915 A * 4/1995 Hogan ..... 222/105
5,988,422 A 11/1999 Vallot
6,186,932 B1 2/2001 Vallot
6,656,132 B1 12/2003 Ouchi
6,783,277 B2 8/2004 Edwards et al.
2001/0017998 A1 8/2001 Terazawa et al.
2002/0131654 A1 9/2002 Smith et al.
2004/0261889 A1* 12/2004 Elgan et al. ..... 141/10
2006/0180589 A1* 8/2006 De Muinck ..... 220/495.06
2007/0064519 A1* 3/2007 Neumann ..... 366/136
2008/0017649 A1* 1/2008 Elgan et al. ..... 220/495.06

FOREIGN PATENT DOCUMENTS

CA 2 359 743 4/2003
JP 0202477 A 1/1990
JP 11292138 A 10/1999

(Continued)

OTHER PUBLICATIONS

Office Action: Japanese Application No. P2009-068641, dated Apr. 24, 2012.

*Primary Examiner* — Andrew Perreault
(74) *Attorney, Agent, or Firm* — Leydig, Voit & Mayer, Ltd.

(57) ABSTRACT

The present invention relates to a system including a tote and a flexible container which fits into said tote, said tote including a box shaped body with four side faces and a floor, said floor having a cut out extending from an edge portion of the floor, said edge portion being part of an edge adjacent to a side face of the tote which comprises a door or a flap, said flexible container having a bottom wall, a top wall and four side walls of a substantial rectangular configuration and made of a flexible plastic sheet material, said container comprising at least one port, wherein said bottom wall comprises said at least a first port in an off-center position, said cut out accommodating said first port in the bottom wall of the container.

The system of the present invention provides for an easy set up and replacement of the container.

17 Claims, 12 Drawing Sheets

(56) References Cited

FOREIGN PATENT DOCUMENTS

| | | | |
|---|---|---|---|
| JP | 2001-194907 | | 7/2001 |
| JP | 2002 037271 | A | 2/2002 |
| JP | 2002 520128 | A | 7/2002 |
| JP | 2004 244104 | A | 9/2004 |
| JP | 2004 529828 | A | 9/2004 |
| JP | 2008 056248 | A | 3/2008 |
| WO | WO 00/04131 | | 1/2000 |
| WO | WO 2004/022440 | | 3/2004 |

* cited by examiner

BIOCONTAINER SYSTEM

CROSS-REFERENCE TO RELATED APPLICATIONS

This patent application claims the benefit of European Patent Application No. 08 005 404.2, filed Mar. 22, 2008, which is incorporated by reference.

TECHNICAL FIELD

The present invention relates, in general, to systems comprising flexible closed containers and a casing with a box-shaped body therefore also called tote. The containers have a three-dimensional structure with a bottom wall, a top wall and four side walls of a substantial rectangular configuration. The closed containers are filled and drained via one or more ports, at least one of them being located at the bottom wall of the containers.

The invention relates more specifically to systems with flexible containers of a large volume. The containers are typically made of a multiplicity of flexible sheets of a plastic material which are bonded to one another along their edges by seams.

BACKGROUND OF THE INVENTION

Systems including three-dimensional flexible containers of volumes of 50 liters or more, in many cases even 500 or 1000 liters or more, are needed for example in the biotech industry for media preparation, mixing of components, formulation and fill. The containers may serve as bioreactors, e.g., in the preparation of vaccines and gene therapy products. The containers may further be used in transportation and storage or as feed vessels.

Containers of such sizes, when filled with water or some other liquid, e.g., a biological broth, can have a weight of up to about 1500 kg or more. The hydraulic pressure created by the large volume of liquid held by the container results in a substantial stress on the seams of the container which, in an unsupported state, might be sufficient to cause rupture of the container.

Therefore, these large volume, three-dimensional flexible containers are accommodated for operation in a rigid box-shaped support casing hereinafter referred to as a tote.

Necessarily, the tote and the flexible container should be in close contact with one another. It is desirable that the walls of the filled flexible container abut the side faces of the tote to reduce the forces resulting from the liquid in the container, especially those acting on the seams to a minimum.

The containers when delivered to the laboratory or production site where they are fit into the tote are in a collapsed folded state. Still their dimensions are quite big and therefore not easy to handle. However, proper positioning and correct orientation of the containers within the totes are of the essence not only in order to avoid problems with the unfolding flexible container like the formation of creases but also to provide the filled up containers within the totes in an optimal orientation such that the surrounding tote side faces can provide a maximum of support to the container walls and seams.

The pressures and forces associated with liquid volumes hold by the containers can cause the container seams to fail or rupture causing leakage of the container even if supported by the tote if the container is not properly positioned within the tote. The liquids held by the container are often enough containing highly valued ingredients. Accordingly, even minor leakages can cause substantive costs. Since a leakage of the container will compromise sterility the loss may not be limited to the portions of liquid seeping through the leakage but the entire contents of the container may be at stake.

In an attempt to provide a maximum support of the sidewalls of the container by the surrounding side faces of the tote US 2002/0131654 A1 suggests a design of those side walls of the container including seams such that in a filled state of the container they may adopt a bellied configuration without exerting additional stress onto the seams.

The correction of an improper orientation of a container within a tote is possible with reasonable effort and with a minor risk of damaging the same only in the beginning of the filling operation. However, having an operator pull a partially filled container to maneuver it into place is laborious and can cause failure of the container material by ripping.

Correct positioning of the container is additionally hampered by tubing which comes typically attached to the one or more ports of the container for simplified set up of the same in its laboratory or production environment. In a number of applications the tubing includes further accessory elements like filtering devices, clamps, vents or the like which make placement of the container within the tote even more troublesome.

Containers of the system are often replaced when a production process has been terminated and the fluid has been withdrawn from the container. An operator in charge of replacing the containers often has to attend to numerous systems at the same time.

This makes it highly desirable to have a system for easy set up available, where the replacement of the containers as well as their filling can be correctly and reliably accomplished with a minimum of an operator's attention.

It is an object of the invention to provide such a system.

BRIEF SUMMARY OF THE INVENTION

The above object is met by a system including a tote and a flexible container which fits into said tote, said tote including a box-shaped body with four side faces and a floor made of a rigid material, said floor having a cut out extending from an edge portion of the floor, said edge portion being part of an edge adjacent to a side face of the tote which comprises a door or a flap, said container having a bottom wall, a top wall and four side walls of a substantial rectangular configuration and made of a flexible plastic sheet material, said container comprising at least a first port, wherein said bottom wall comprises said first port in an off-centre position, said cut out of the floor accommodating said first port of the bottom wall of the container.

The off-center positioning of the port in the bottom wall of the container puts it within easy reach of an operator when installing the container in a tote.

The door or flap when opened provides convenient access to the interior of the tote and facilitates insertion of a new container and its alignment within the side faces of the tote. The match of the cut out and the first port at the bottom wall in addition facilitates correct and reliable positioning of the container.

DETAILED DESCRIPTION OF THE INVENTION

The inventive system may include a container having a multiplicity of ports which may all be located at the bottom wall of the container in an off-center position. Often an inlet port for feeding liquid into the container and an outlet port for draining the liquid from the container will be provided.

The first port at the bottom wall of the container may serve as an inlet port as well as an outlet port.

If an additional port is provided as an inlet port it is often located at the top wall of the container. Preferably the first port located at the bottom wall will serve as an outlet port since this facilitates complete draining of the container. Additional ports at the bottom and/or top wall may be used, e.g., for sampling or testing.

The cut out in the floor of the tote may accommodate two or more of the outlet ports. Alternatively more than one cut out may be provided in the floor of the tote to accommodate the multiple ports provided at the bottom wall of the container.

Also, multiple inlet ports may be provided at the top wall of the container. A preferred position of the inlet port within the top wall will be off-center, similar to the off-center position of the first port at the bottom wall for ease of access.

A multiplicity of inlet ports may be provided, e.g., to feed several liquids separately into the container and/or to provide access for testing equipment or sampling.

Alternatively one or more of the inlet ports may be accommodated in the bottom wall of the container. Again a preferred position is an off-center position.

The off-center position of the first port and possible further ports (outlet and/or inlet) is preferably within a distance from an edge of the bottom wall of the container which is half the height of the container or less, especially in containers where the height of the container is up to the depth of the same or less. In cases where the height of the container is larger than the depth of the container the distance preferably is within about one third of the height or less.

Preferably the off-center position of the port(s) is located within a short distance, e.g., about 20 cm or less from an edge of the container formed by the bottom wall and a side wall.

The term edge as referred to in connection with the definition of the off-center position of the first port may correspond to a seam connecting the bottom wall sheet and a side wall sheet. In other embodiments the edge is represented by a fold line or an imaginary line separating the bottom wall portion of a sheet of plastic material from an integrally formed triangular or trapezoid wall portion thereof.

The cut out has an open end at the edge of the floor and terminates in a closed end versus the interior of the tote. The cut out can be designed in various configurations and may be about semicircular.

Preferably the cut out is provided in the form of a slot extending from an edge of the floor into the interior of the tote. The length of the slot is preferably selected such that the first port at the bottom wall is accommodated at the end of the slot.

The off-center position of the first port at the bottom wall allows designing the slot with a relatively short length. Thus the mechanical stability of the floor remains essentially unaffected.

In order to support complete draining of the fluid treated in the container the floor of the tote may be slightly slanted in the direction of the cut out which then marks the lowest section of the floor.

Preferably the container of the present invention is made of four sheets of flexible plastic material, a first sheet forming the bottom wall, a second the top wall and a third and fourth sheet forming two side walls of opposite sides of the container. Each one of the sheets comprise at their opposite ends triangular or trapezoid shaped wall parts integrally formed with the sheets. These wall parts are joined together and form the third and fourth side walls, respectively.

The term closed container as used herein means that the container is completely sealed off against the environment and communication with the interior of the container is possible only via the port or ports.

The containers typically are delivered in a laid flat state to the market, said first and second side walls comprising fold lines at a position of about half height thereof, said first and second side walls being folded inwards and said third and fourth side walls formed of the joined triangular or trapezoid shaped wall portions are folded outwards.

Containers of such flat structure may be easily set up in the tote, the outwardly folded third and fourth sidewalls resting flapped upwards against side faces of the tote.

The door or flap provided at one side of the tote preferably extends over the substantially whole length of said side face. Correct and easy positioning is thereby greatly facilitated.

A door may be a two-wing door which provides an improved control of the correct positioning of the container during closing the door.

The door or flap may be designed and positioned such that it overlaps the edge portion of the floor which accommodates the cut out in the closed position. Thereby the door or flap locks the container in place when the tote is shut.

Typically, the tote may have the floor in an elevated position to facilitate insertion of the container and associated tubing.

Preferably the tote comprises at its upper end connecting means to allow forming a stack of two or more of the totes in a safe and convenient manner.

Preferably the first port at the bottom wall of the container comprises a tubular element extending downwardly from said bottom wall of the container, said tubular element having and end section for receiving, e.g., a flexible tube.

More preferably, the first port comprises at its end within the interior of the container a disk shaped collar which rests against the bottom wall of the container and which preferably serves to join the first port to the bottom wall.

In an even more preferred embodiment said opposite end comprises a section of an increased diameter which opens into the interior of the container.

Said section of increased diameter preferably includes a support member to support the top wall when the container is in a collapsed state in order to promote proper draining of the container when the first port is operated as an outlet port. The support member may have a substantially hollow cylindrical structure, preferably including one or more lateral drainage channels to facilitate drainage of the container. The support member may alternatively comprise a number of separate wall portions or studs to support the top wall in a collapsed state of the container.

A similar design may be used for ports provided at the top wall of the container, especially when they are operated as outlet ports.

The tote of the present invention can be made of variety of materials. One material commonly used is stainless steel.

The side faces of the tote and/or the door or flap may have a series of small sight openings to allow one determine the level of liquid in the container.

In order to easily accommodate the first port provided at the bottom of the container and attached tubing and facilitate set up of the container within the tote the dimensions of the cut out in the floor of the tote should be sufficiently wide. However, a too wide cut out may create problems since part of the bottom wall of the container will remain unsupported.

According to a preferred embodiment of the present invention the container preferably comprises a support element positioned adjacent to or attached to the first port at the bottom wall on the outer surface of the container.

Use of a support element positioned adjacent to or attached to said first port of the container allows a large cut out in the floor of the tote without incurring the risk of damage or misalignment of the container upon set up and filling. While the bottom wall portion of the container finds adequate support by the upper surface of the support element without disturbing positioning of the container and its expansion within the tote upon filling the dimensions of the cut out may selected such that it allows easy set up of the container within the tote, even in cases when the container comes with extensive tubing and/or auxiliary equipment.

The support element is preferably designed such that it closes the cut out substantially completely except for the space needed for said first port. The upper surface of the support element which is in contact with the bottom wall of the container is flush with the upper surface of the floor of the tote.

In one alternative the support element may be detachably held at said first port. In another alternative the support element is permanently joined to said first port.

In preferred embodiments the support element is provided with one or more guiding faces which cooperate with corresponding surface area(s) provided at the edge of the cut out in the floor of the tote. The guiding faces provide a means for correct and reliable positioning of the container within the tote. It not only positions the first port adequately within the cut out of the floor but assists at the same time in correctly positioning of the container as a whole within the tote.

In a further preferred embodiment of the present invention locking means providing for an interference fit or force fit are provided which secure the support element when inserted in the cut out against horizontal and/or vertical unintentional displacement.

It is readily understood that a container of the inventive system may comprise more than one support element when multiple ports are provided at the bottom wall of the container. Also a single support element may be designed to support the bottom wall of a container in an area which accommodates more than one port.

The support element cooperates with the cut out and is preferably designed to slide into the cut out in a substantially horizontal direction.

The guiding faces of the support element may be part of a dovetail structure which then may at the same time provide locking means to secure the supporting element against forces exerted in a vertical direction.

While a dovetail structure has its advantages as noted above it usually requires an exact orientation of the support element with the container attached to it to the tote floor edge and the cut out upon insertion. This may be troublesome, especially in cases where long tubing is fixed to the first port.

In many instances the provision of simple slanted straight guiding faces on the underside of the support element may be found satisfactory for the proper insertion and alignment of the container.

Often it is sufficient when the support element is engaged by locking means upon sliding into its final position. Examples for locking means are catches, hooks, recesses, projections and snap-fit connectors.

The locking means need not be provided all along the length of the cut out. It has turned out that an interference fit in a small section along the cut out is usually sufficient. Preferably such interference fit is provided in a section at about the half to one third of the length of the cut out as measured from the edge of the floor.

Once the support element with slanted guiding faces is slipped into its final position within the cut out and is secured against a movement in vertical direction the slanted guiding faces cooperate with corresponding faces at the edge of the cut out and secure the supporting element also against lateral movement.

The supporting element may be provided with a grip or handle for ease of insertion of the support element with the container attached to it in the tote.

The support element may be designed such that it is flush with the edge of the floor of the tote. The door or flap of the tote once closed may then be used to secure the support element against withdrawal from its final position.

Preferably the support element is manufactured from a plastic material, especially a plastic material similar to the one used for the manufacture of the port to which it is attached.

According to further preferred embodiment of the present invention the sheet material forming the walls of the container is made from a multilayer plastic film.

Use of multilayer plastic films allows adapting the characteristics, especially the mechanical and chemical properties, of the container to various applications.

Of quite some interest is the transparency of the film, since it easily allows optical control of the filling and drainage procedure of the container and eventually any reaction taking place in the fluid contained in the container.

Polyethylene is a highly transparent polymer material easily processed to a film. While other polymers like polyester may be preferred because of their superior mechanical properties, polyethylene film as at least one of the layers of the multilayer sheet material has the additional advantage that it is readily available in grades which practically contain no releasables or extractables.

Polyethylene film layers are therefore preferred as innermost layers of the container.

In highly transparent multilayer sheet materials also a second layer of polyethylene may be advantageous. This further decreases the risk of release of unwanted material into the liquid hold by the container.

In many applications it is of import to avoid ingress of oxygen and/or carbon dioxide into the container. Therefore, preferred multilayer sheet materials generally include a gas barrier layer, especially a barrier layer for oxygen and/or carbon dioxide.

A suitable material for such barrier layers is EVOH. This polymer material has the advantage that it can be used as an intermediate layer, e.g., between two polyethylene layers. Such multilayer sheet materials still have a high degree of transparency.

The polymer material used for manufacturing the port at the bottom wall is preferably selected from plastic material which is compatible with, more preferably similar to the plastic material of the sheet material. This generally applies also to further ports which may be provided at the container.

In case a multilayer sheet material is used compatibility with the polymer material of the innermost layer is of importance.

In order to cope with the varying volumes to be accommodated in the containers of the present invention according to a further aspect of the present invention a set of a multiplicity of flexible containers is provided.

All containers of one set have a substantially identically sized bottom and top wall, whereas the side walls have differing dimensions.

Each container of a set will fit in the same tote, the side faces of which will be provided with a height to accommodate the largest one of the container.

Exemplary dimensions for a bottom wall for a set of containers holding, e.g., 100, 200 and 250 liters, would be about 720 mm×520 mm. The height of the container will vary accordingly from about 285 mm to about 565 mm to about 667 mm, respectively.

For larger containers preferably a different set of containers with a bottom wall of larger dimension would be provided. Such set then requires a correspondingly dimensioned tote.

Characteristic for all containers of a set is the substantially identical off-centre position of the first ports at the bottom wall.

BRIEF DESCRIPTION OF THE SEVERAL VIEWS OF THE DRAWINGS

FIGS. 1A-1D of the drawings show closed containers 10 made in accordance with the present invention and comprising a bottom wall 12, a top wall 14, a first side wall 16, a second side wall 18, a third side wall 20 and a fourth side wall 22.

Figure 1A:
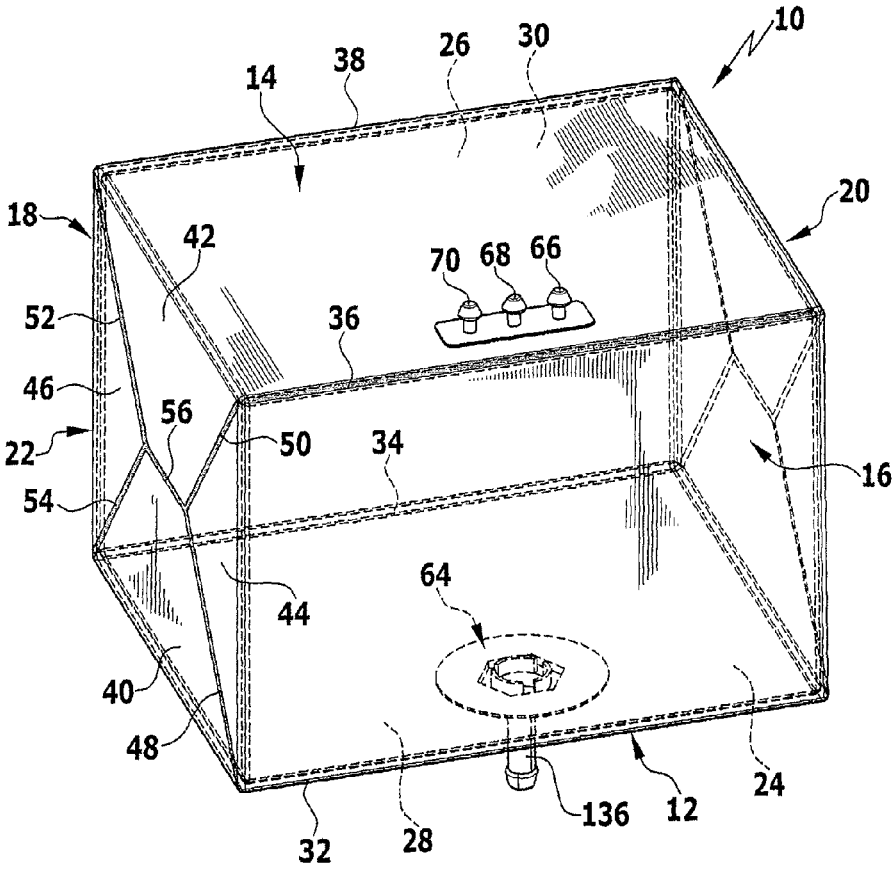
FIG. 1A is a perspective view of a container of the present invention.
Figure 1B:
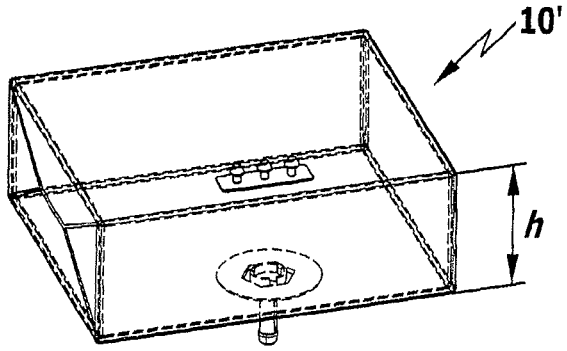
FIGS. 1B-1D are perspective views of a multi licit of containers according to the resent invention.
Figure 1C:
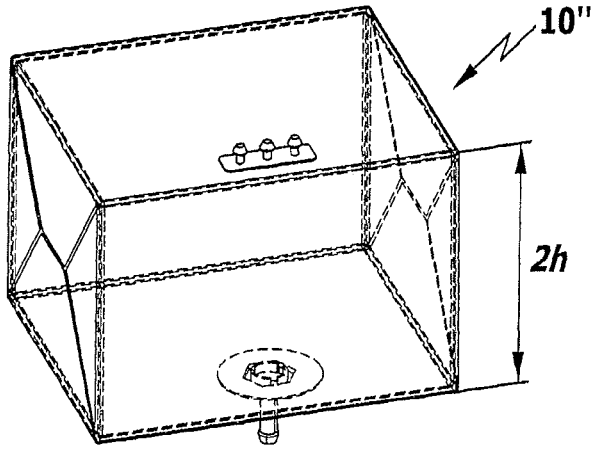
Figure 1D:
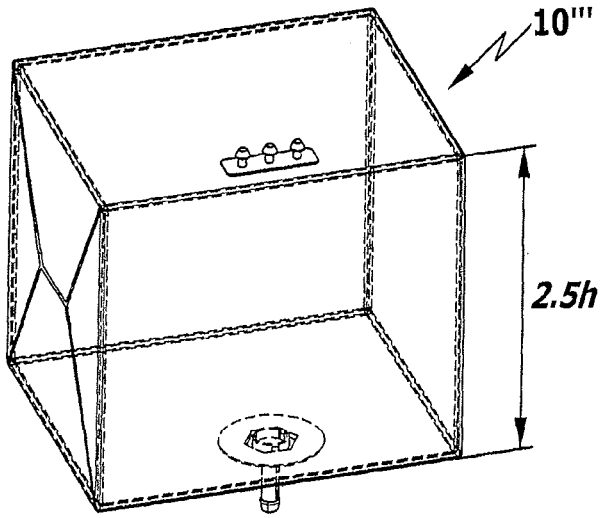

The container 10 is generally made from four pieces of a flexible plastic sheet material, where a first sheet 24 provides for the bottom wall 12, a second sheet 26 provides for the top wall 14, a third sheet 28 provides for the first side wall 16 and a fourth sheet 30 provides for a second side wall 18, the first and second side walls 16, 18 being located on opposite side of the container 10.

Each one of the first, second, third and fourth sheet materials 24, 26, 28 and 30 have a substantial rectangular shape. Opposite edges of the sheets 28 and 30 forming the side walls are joined with edges of the bottom and top wall sheet materials 24, 26 by seams 32, 34, 36 and 38 resulting in a sleeve like structure.

Each one of the sheet materials comprise at opposite ends thereof triangular or trapezoid shaped wall portions 40, 42, 44 and 46. These wall portions 40, 42, 44, 46 are joined to one another to form the third and fourth side walls 20, 22. The joined portions are represented as seams 48, 50, 52, 54, 56. The container is now in a closed state.

Figure 2:
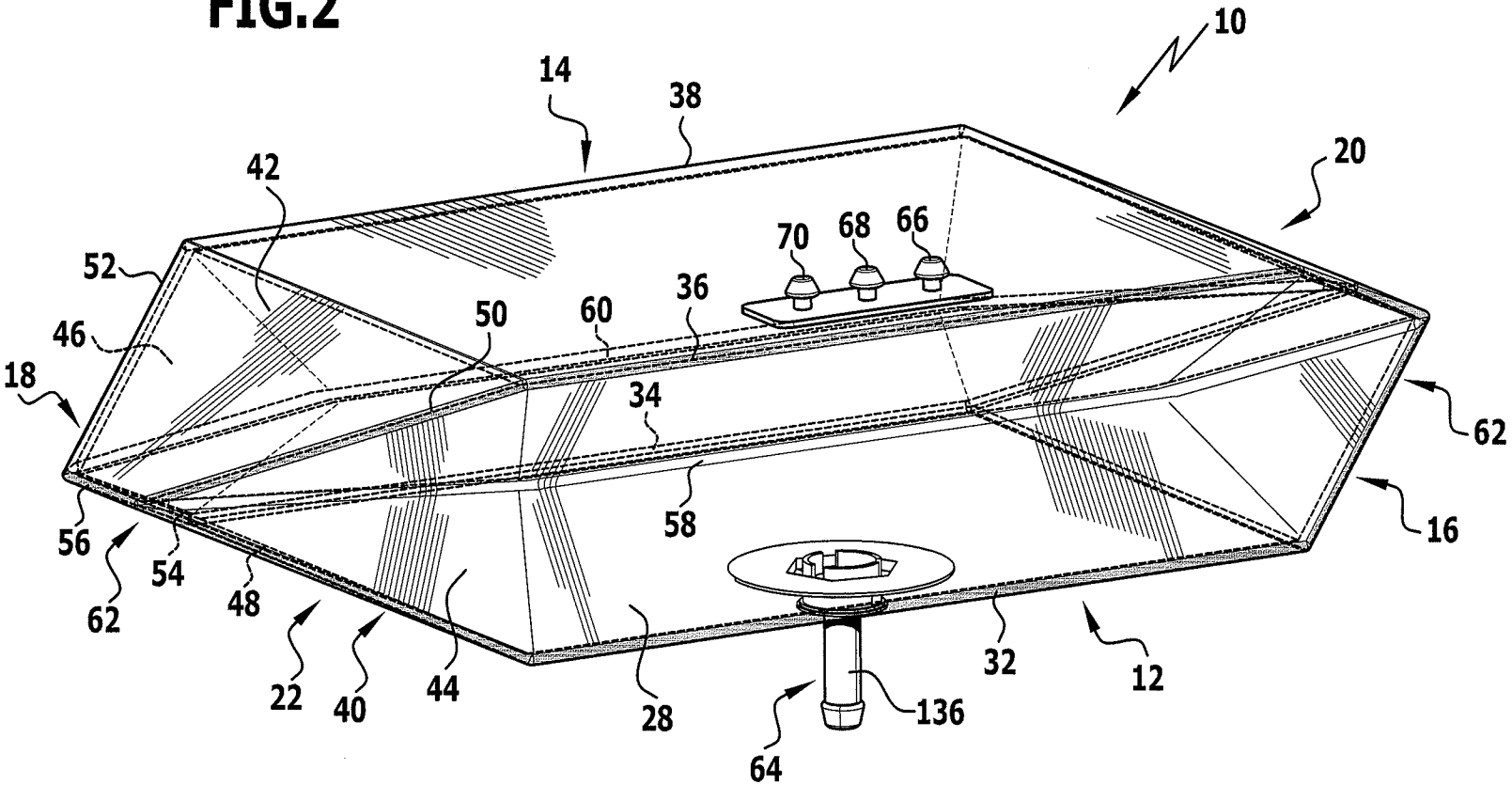
FIG. 2 is a perspective view of the container of FIG. 1 in a folded state.

FIG. 2 shows container 10 in a substantially folded not yet completely laid flat state where the side walls 16 and 18 are folded in inwardly along fold lines 58 and 60, respectively. FIGS. 1A-1D in contrast shows the containers 10 in fully expanded state.

The third and fourth side walls 20, 22 are folded outwardly from the body of container 10 and laid flat as substantially triangular or trapezoid shaped flaps 62.

The bottom wall 12 of container 10 accommodates in an off-center position a first port 64 which may be used as an outlet port. The top wall 14 of container 10 accommodates three further ports 66, 68 and 70 which may be used as inlet ports. It is understood that the first port 64 may be used as an inlet port and one or more of the further ports 66, 68 and 70 may be used as outlet ports. For ease of reference first port 64 will be called an outlet port and further ports 66, 68 and 70 will be called inlet ports throughout the following description.

The off-center position of outlet port 64 as well as of the inlet ports 66, 68 and 70 are within a distance from the seams 32 and 36 which corresponds to less than one third of the height of the container which corresponds to the vertical dimension of the side walls 16 and 18 in a fully expanded state of the container, respectively. Further they are about centered with respect to the length of the seams 32 and 36, respectively.

Instead of the seams 32 and 36 representing an edge of the bottom and top wall, respectively, the distance of the ports in their off-center position from the edge may be measured in other embodiments from a fold line or imaginary line separating the bottom and top wall portion of a sheet from a triangular or trapezoid wall portion thereof.

It is readily understood that the outlet and inlet ports are regularly mounted in the bottom and top wall sheets 24, 26 prior to the assembly of the container 10.

As mentioned before the containers of the present invention while made from a flexible plastic sheet material are designed to hold large volumes, e.g., 100, 200 or 500 liters or even more. Because of the forces exerted by the liquid hold within container 10 the container 10 needs a casing structure supporting the container walls in order to be safely operated.

Figure 3A:
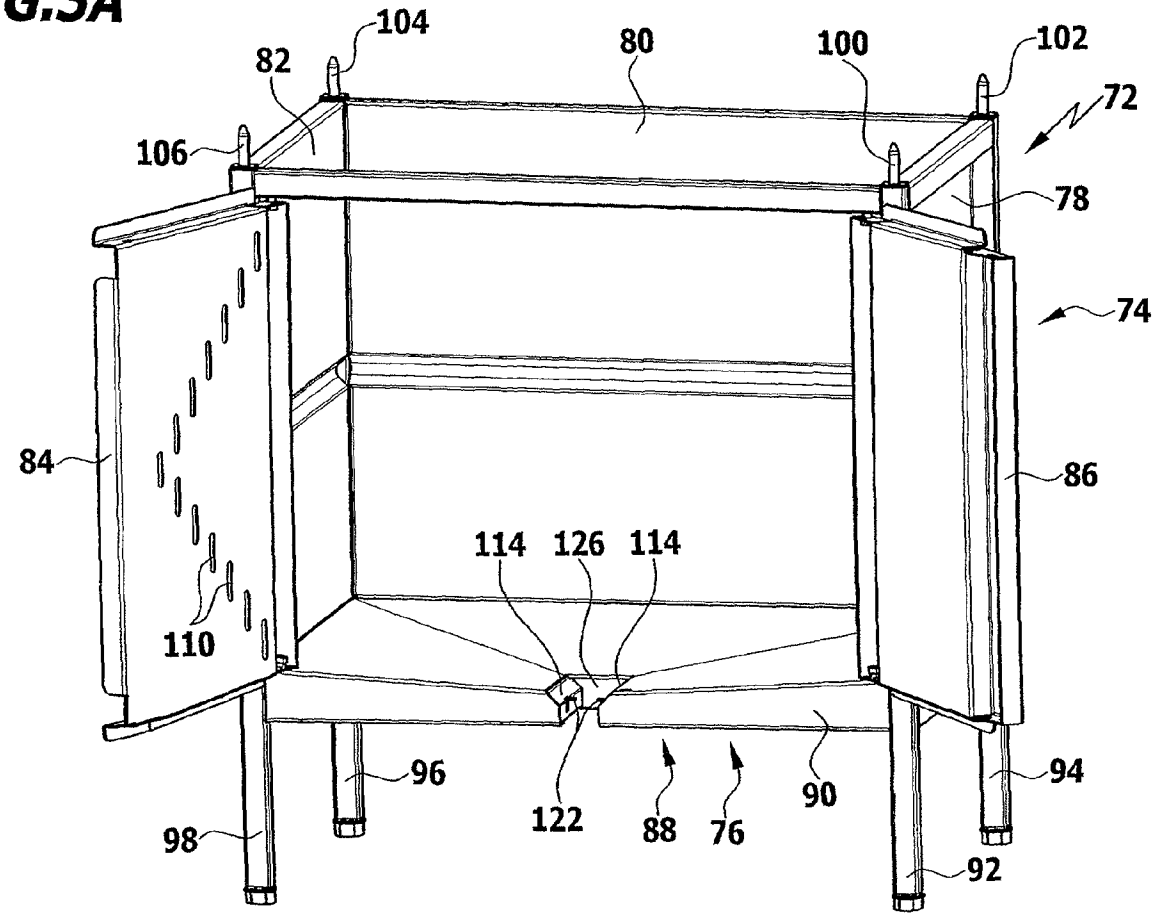
FIG. 3A is a perspective view of a tote of the present invention.
Figure 3B:
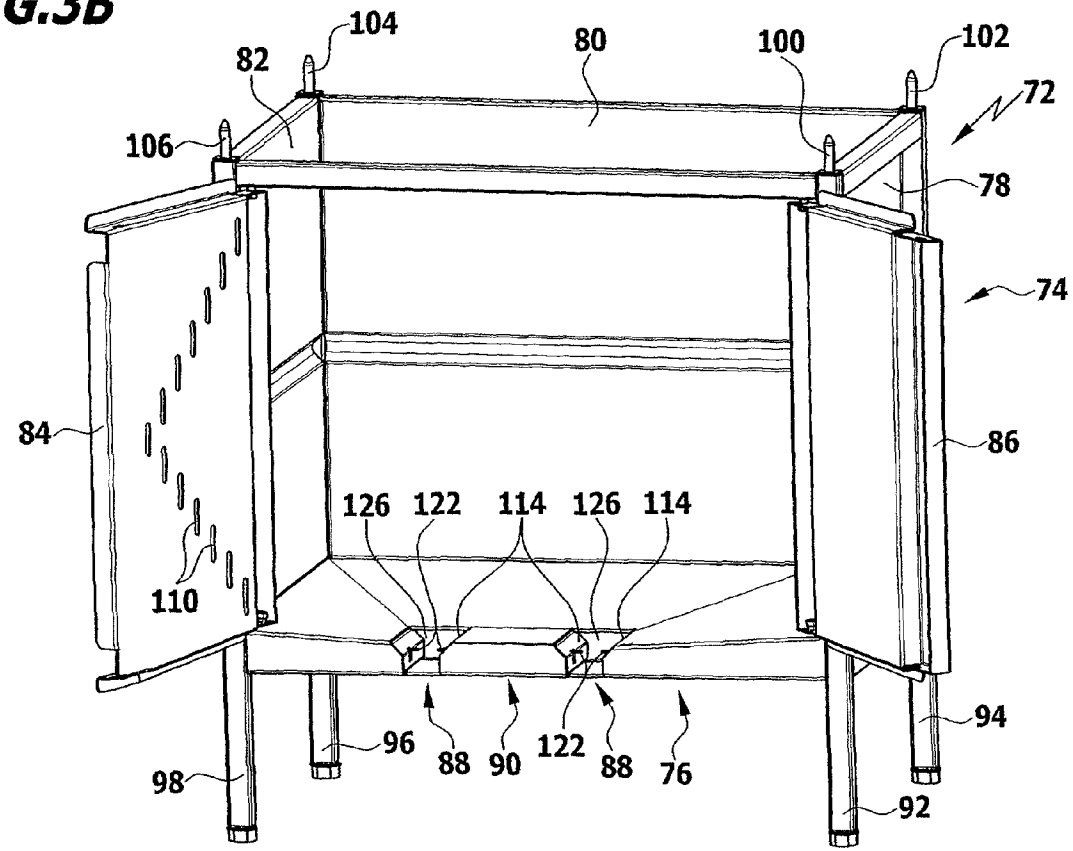
FIG. 3B is a perspective view of a tote having a floor with two cut out portions according to the present invention.

FIGS. 3A and 3B show such casing structures in the form of tote 72 which comprises a box shaped body 74 with a floor 76 and closed side faces 78, 80 and 82.

The fourth side face of the box shaped body 74 is provided by a door having two wing elements 84 and 86. The two door elements 84 and 86 are hinged at a corner of the box shaped body 74 so as to provide an access to the interior of the box shaped body 74 over substantially the whole width of said side face.

The floor 76 of the box shaped body 74 is provided with a cut out 88 which in the embodiments shown in FIGS. 3A and 3B are often an elongated slot-like structure extending from a front edge 90 of floor 76 where it is open into the interior of body 74 terminating in a closed end.

The floor 76 of tote 72 preferably has a slanted configuration centering on the portion of floor 76 which is represented by the cut out 88 which facilitates drainage of container 10. The cut out 88 marks the lowest portion of floor 76.

The cut out 88 in floor 76 of tote 72 accommodates, once a container 10 has been placed within the tote 72, the outlet port 64 which will be described in more detail in connection with FIG. 4.

Because the cut out 88 extends from the front edge 90 of the box shaped body 74 which is freely accessible when the door wing elements 84 and 86 are open the container 10 with its outlet port 64 and any possibly associated tubing or auxiliary equipment may easily and reliably be positioned within the box shaped body 74. Even if the tubing extends to ten meters or more which provides quite some troubles in setting up a container 10 in prior art totes correct placement of container 10 within the body 74 of tote 72 can be accomplished very easily.

In order to provide the box shaped body 74 with sufficient clearance versus the ground level underneath the tote 72 is provided with legs 92, 94, 96 and 98 which support the box shaped body 74 at each corner thereof above ground level. Easy accommodation of any tubing which may be associated with the outlet port 64 is thereby provided.

At the upper end of the box shaped body 74 the tote 72 in addition preferably comprises at the corner portions studs 100, 102, 104 and 106 which serve as connecting means to a tote which may be stacked on top of tote 72. Legs 90, 92, 94 and 96 will then have corresponding openings at their lower end portion to receive these studs 100, 102, 104 and 106.

In order to facilitate filling of the containers set up within tote 72 it is preferable to have some openings provided in a side face of the box shaped container 74. More preferably and conveniently such openings are provided in a closure member for the front side face of the box shaped container 74, in the embodiments shown in FIGS. 3A and 3B represented by the two door wings 84 and 86.

Although openings can be provided at various side faces it is most often sufficient to have it included in the front side face only. As exemplified in the embodiment shown in FIG. 3 the openings may be included in one of the door wings only.

To that effect door wing 84 has a multiplicity of slot like through holes 110 which are arranged in a staggered configuration which conveniently allows optical control of the filling level of the container 10 inside the box shaped body 74 even when door wings 84 and 86 are closed.

Figure 4:
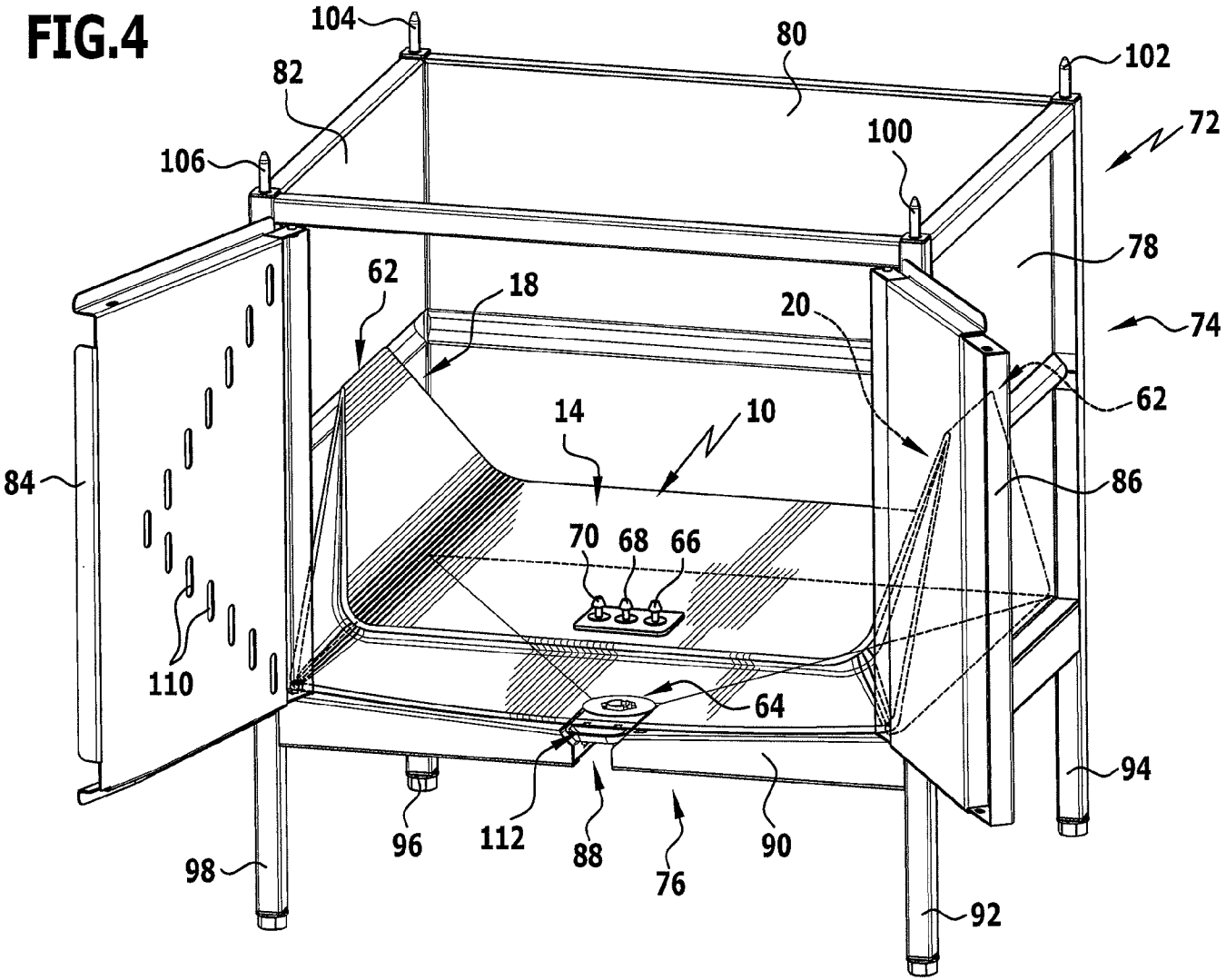
FIG. 4 is a perspective view of the tote of FIG. 4 supplied with a container of FIG. 1 in a collapsed folded state.

FIG. 4 shows tote 72 with the container 10 inserted within the box shaped body 74, the outlet 64 of container 10 being accommodated within cut out 88 of the floor 76. The flaps 62 of container 10 are bent up and rest against the side faces 78 and 82 of the tote.

In other embodiments of container 10 (not shown) the off-center position of the outlet port 64 is defined with reference to a fold line or imaginary line separating the bottom wall portion of a sheet from the triangular or trapezoid wall portion of the same sheet. The flaps of the folded side walls comprising seams would then rest against the back side wall 80 and the door wings 84, 86, respectively.

In order to facilitate set up of container 10 within the box shaped body 74, the cut out 88 of floor 76 is preferably amply designed so as to allow inserting of the outlet ports 64 in an unobstructed and easy way even if the outlet port 64 is already provided with extensive tubing and/or additional auxiliary equipment (not shown).

In case of the embodiment shown in FIG. 4 the width of cut out 88 is about twice what would be needed to accommodate outlet port 64 in the installed position of container 10 within the box shaped body 74.

The large volumes of liquid which may be hold by container 10 exert a substantial pressure on the bottom wall of the container which as noted above is made of flexible plastic sheet material. In order to avoid that the excessive forces may unduly deform and/or rip the sheet material forming the bottom wall 12 of container 10 causing liquid to leak out from the portion where outlet port 64 is attached to the bottom wall of container 10 the present invention proposes to preferably to locate a support element 112 within cut out 88 in order to support those portions of the bottom wall 12 of container 10 which extend over cut out 88.

While the support element may be provided in the form of various and quite different structures the main feature of such support element 112 is to provide a surface which in a fully inserted position within cut out 88 is substantially flush with the upper surface of floor 76.

In the specific embodiment shown in FIG. 4 the support element 112 essentially fully occupies the opening provided by cut out 88 except for the portion which is needed to have the outlet port 64 extend through floor 76.

The support element 112 will be supported by the floor 76 and therefore sufficiently support the bottom wall 12 of container 10 such that no risk of ripping of the plastic material and debonding the outlet port 64 exists any more even in a fully filled state of container 10.

Due to the provision of support element 112 dimensioning of cut out 88 is no longer restricted by considerations concerning safety of the sheet material of the bottom wall 12 of container 10 and its bond to outlet port 64.

As may be best seen from FIGS. 3A and 3B the cut out portion 88 of floor 76 of tote 72 has along its upper lengthwise edges chamfered surface areas 114 which provide a bearing for support element 112.

Support element 112 itself preferably comprises likewise chamfered faces 116 on both parallel sides thereof which come into essentially full contact with the chamfered surface areas 114.

The use of the chamfered surface areas 114 as part of the cut out 88 and correspondingly chamfered faces 116 on the lower side of the support element 112 provides two functions. First of all, the support element 112 can be inserted in a sliding motion into cut out 88 together with the container 10 to which it is usually attached prior to mounting of container 10 within the tote 72.

In addition, the chamfered areas 114 and faces 116 cooperate to center the support element 112 and thereby outlet port 64 and container 10 attached to it.

The support element 112 may preferably be provided with additional functions which will be described in the following in connection with FIGS. 5*a* and 5*b*.

Figure 5A:
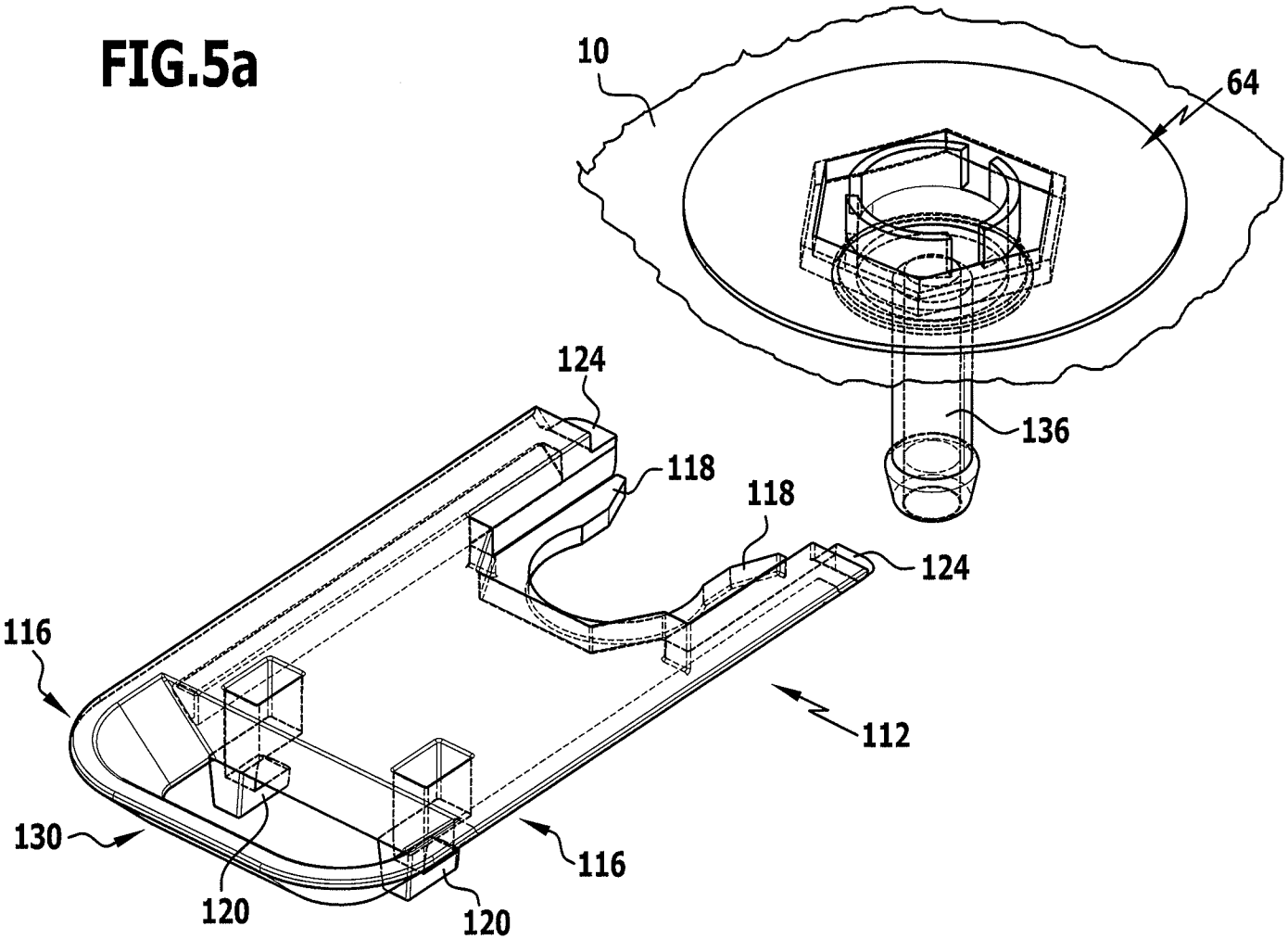
FIG. 5*a* shows a detail of container 1 and a support element.
Figure 5B:
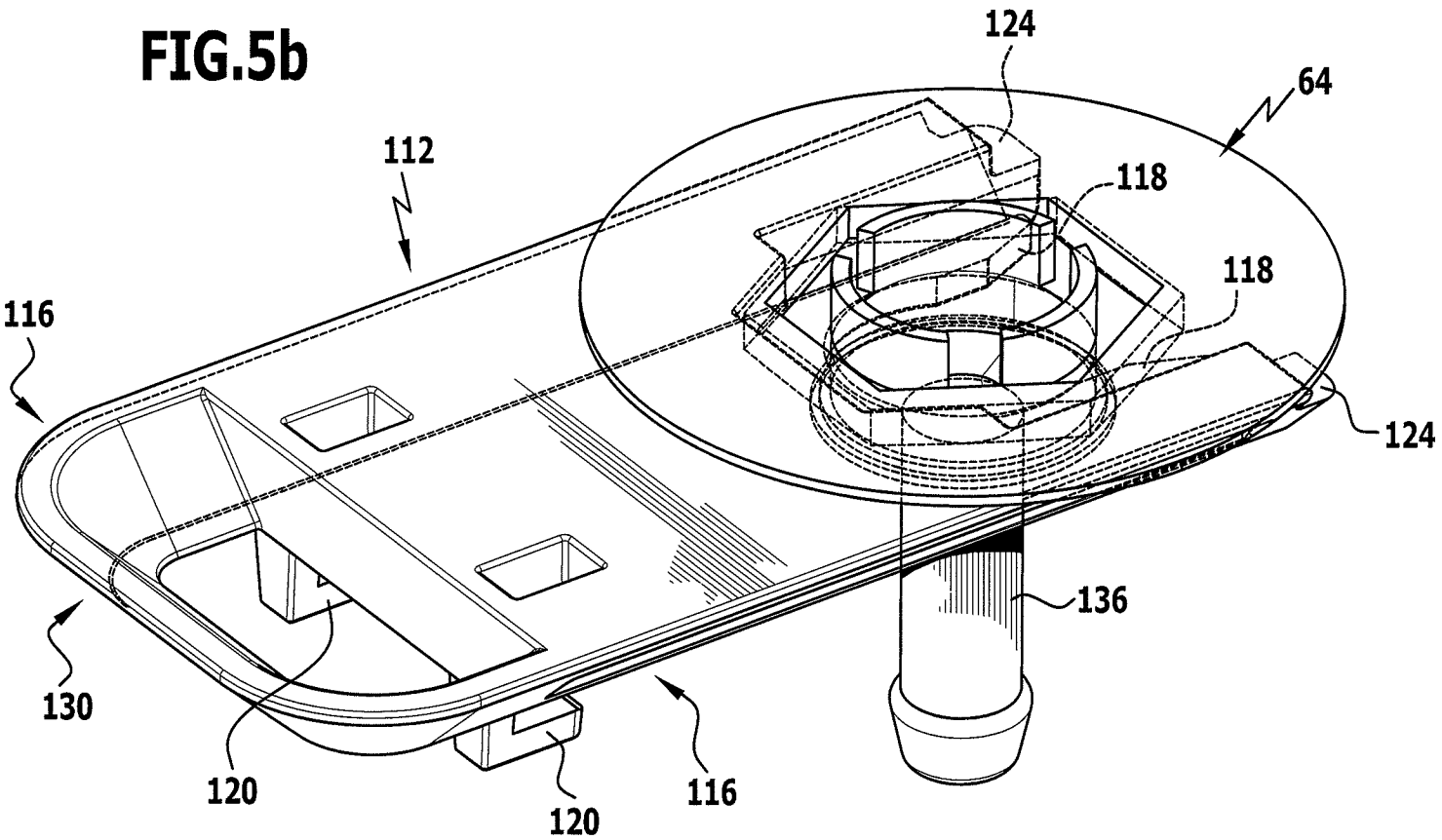
FIG. 5*b* shows the detail of FIG. 5*a* with the support element in place.

In one embodiment, as shown in FIGS. 5*a* and 5*b*, the support element 112 is provided as a separable component to outlet port 64. To that effect the support element 112 comprises a recess provided with a pair of elastically deflectable legs 118 which easily snap on a downwardly extending portion of outlet port 64.

Of course such detachable support element 112 may also be used to be snapped on the outlet port 64 once the container 10 has already been inserted within the body 74 of tote 72. It then would serve to finally position the outlet port 64 within the cut out 88 of floor 76 and supporting at the same time the wall portions of bottom wall 12 extending over cut out 88.

It is readily appreciated that support element 112 may also be positioned in a sort of vertical movement within cut out 88 and would have the same two functional advantages.

Alternatively the support element may be permanently fixed to the outlet port 64 and the same advantages would be provided.

In order to secure the position of outlet port 64 and thereby the position of container 10 as a whole within the boundaries of the body 74 of tote 72 the support element 112 preferably comprises locking means which secure the position of support element 112 when it has been pushed into its final position within cut out 88 against vertically acting forces. This can be achieved in a variety of ways, one of which is exemplified in FIG. 5*a* and more specifically in FIG. 6.

To that extent, the support element 112 is provided at its lower side with hooks 120 whereas the cut out 88 of floor 76 is provided with two projections 122 which will engage the hooks 120 upon full insertion of support element 112 into cut out 88.

In addition or alternatively, the support element 112 may be provided, e.g., at its foremost end with projections 124 which slide in a recess provided at the end face 126 of cut out 88 (not shown). Such projections cooperating with recesses could be also provided in a lateral position of the support element and the cut out.

In order to facilitate handling of support element 112 be it on the occasion of fixing it on the outlet port 64, being it during handling of the container 10 and its final positioning within tote 72 the support elements 112 may be provided with a grip portion 130 at one end portion thereof.

Figure 7:
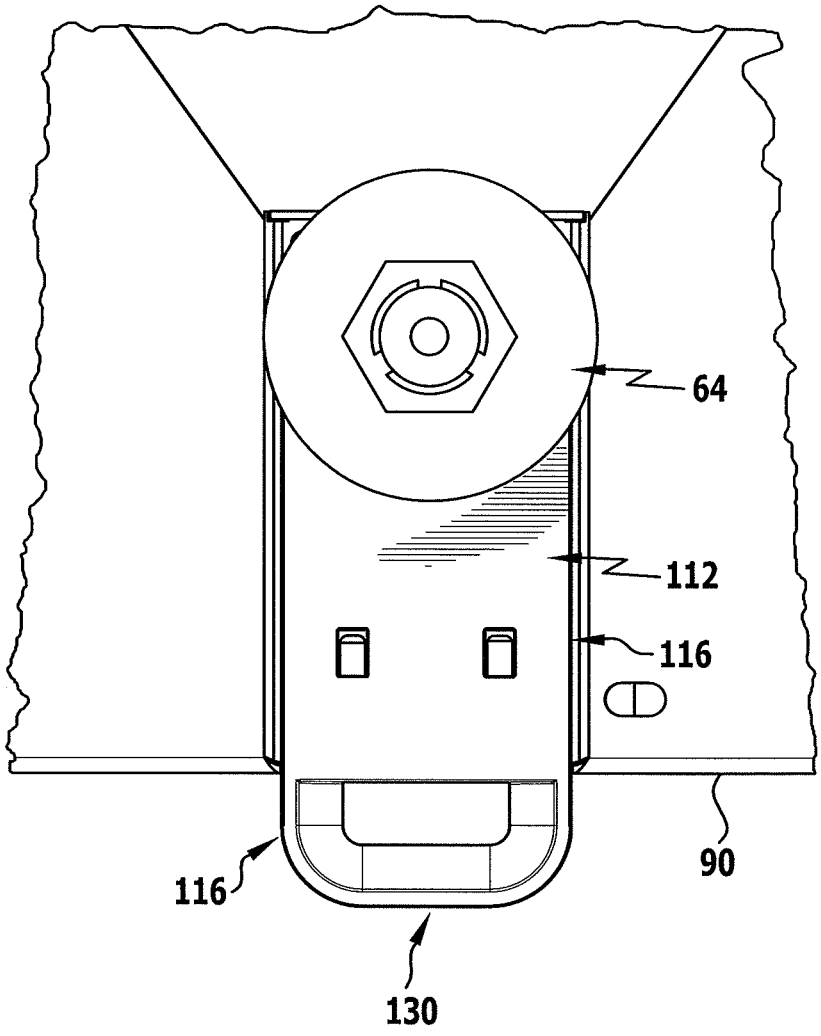
FIG. 7 shows a top view of an alternative support element inserted in the tote of FIG. 3A.

The length of the cut out 88 and the length of the support element 112 may be selected such that the grip projects from edge 90 of floor 76 such that it may be easily gripped when the container 10 has to be removed from tote 72 (cf. FIG. 7).

Figure 6:
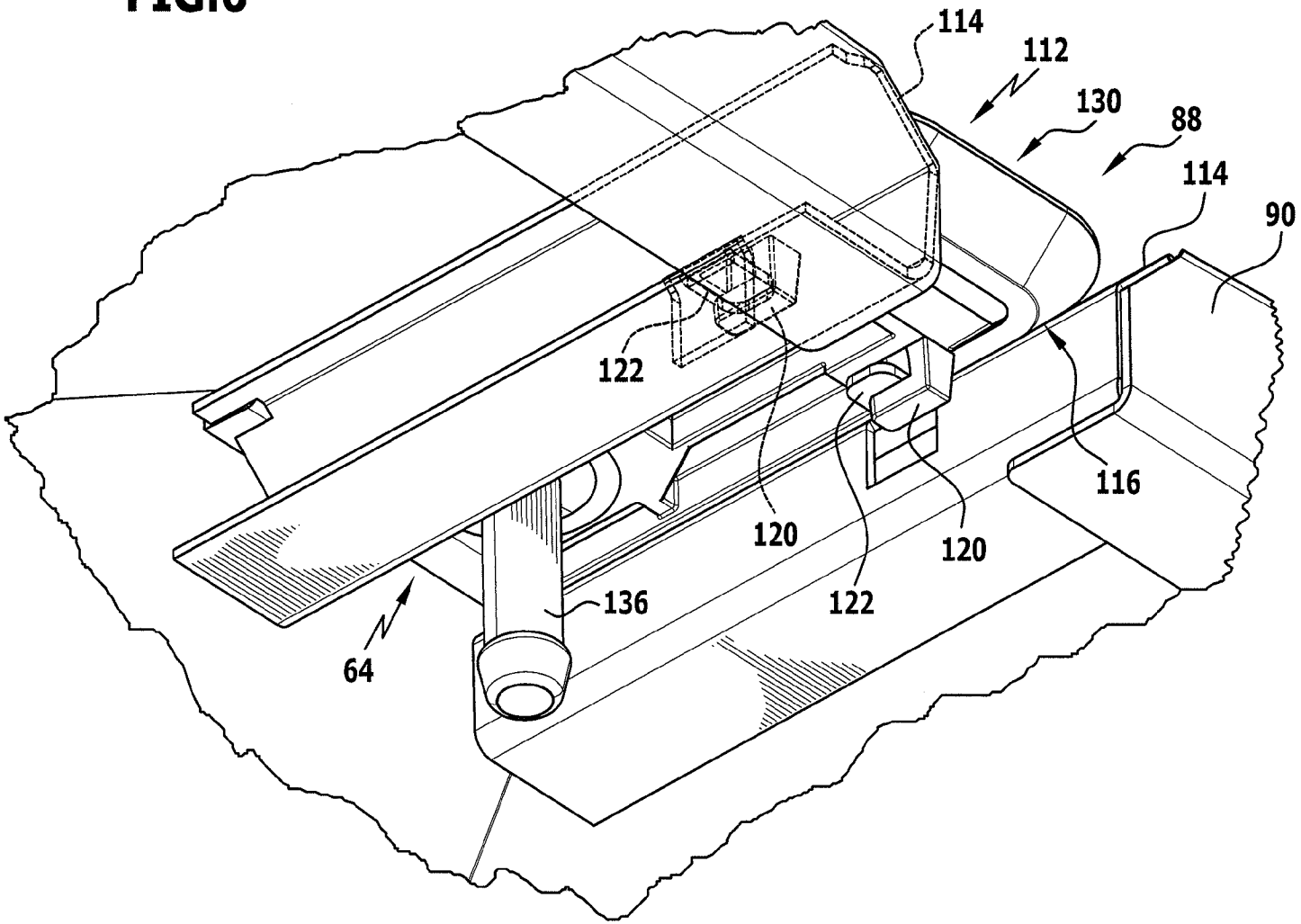
FIG. 6 shows a detail of the support element of FIG. 5*b* in connection with a part of the floor of the tote of FIG. 3A in a perspective bottom view.
Figure 8:
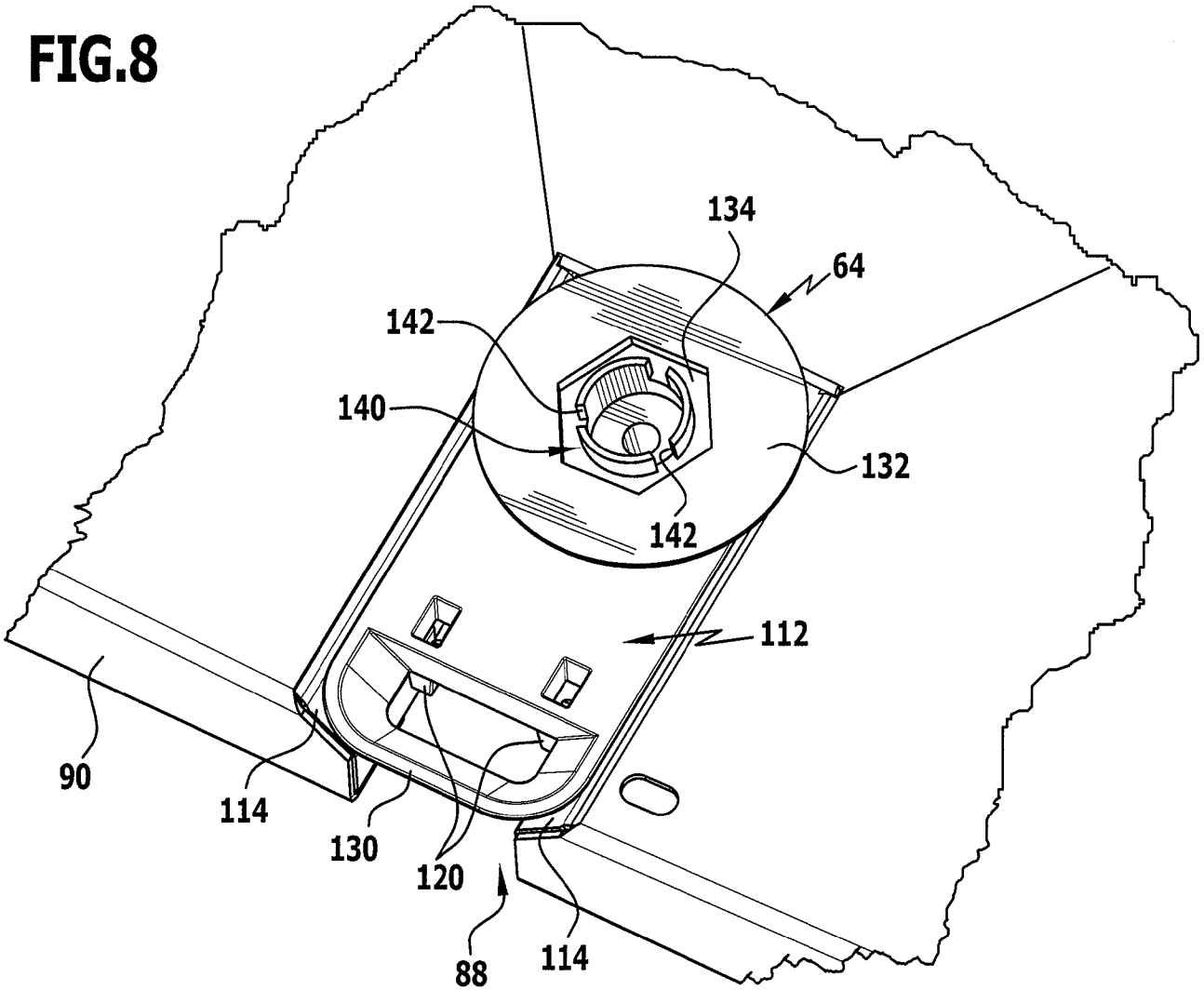
FIG. 8 shows a perspective top view of the support element of FIG. 5*b* inserted in the tote of FIG. 3A.

According to another aspect of the present invention, the length of cut out 88 and the length of the support element 112 may be selected such that upon full insertion of the support element 112 into cut out 88 the grip portion 130 of support element 112 is flush with edge 90 of floor 76 of tote 72 (cf. FIGS. 6 and 8).

In connection with FIGS. 5*a*, 5*b*, 7 and 8 another specific feature of outlet port 64 will be described in the following.

Outlet port 64 comprises at its one end opening into container 10 a disc shaped collar 132 which may be formed integrally with the outlet port 64. Collar 132 is bonded to the inner surface of the bottom wall of container 10.

In its central portion, the collar 132 is provided with a recessed portion 134 which in its lowermost and central part provides fluid communication to an outlet, e.g., a tube element 136 which may be used to attach tubing and eventually other auxiliary equipment to outlet port 64. The recessed portion 134 opens into the interior of container 10.

Within recess 134 a circular wall 140 is provided which projects above the upper surface level of collar 132 and which includes three radial channels 142 connecting the outer portion of recess 134 with the innermost part of recess 134 within the cylindrical wall 140.

These structural features of outlet port 64 have the advantage that once container 10 collapses during draining top wall 14 may not come into direct contact with the edge portions of recess 134 and thereby close outlet port 64 prematurely. This is an important feature to outlet port 64 since the negative hydraulic pressure (suction) present at outlet port 64 upon drainage of container 10 could effectively suck the top wall 14 and bring it into sealing contact with collar 132. The cylindrical wall 140 by extending beyond the upper surface of collar 132 prevents such a situation and in addition allows continued drainage of remaining liquid from container 10 via channels 142. Similar features are advantageous once an outlet port at the top wall is used.

It is readily apparent that the cylindrical wall 140 could be replaced by other supporting structures like a multiplicity of studs or some, e.g., radially oriented straight wall portions as long as they extend beyond the upper surface of collar 132 and as long as they provide unobstructed access for the liquid to tubing element 136.

Figure 9:
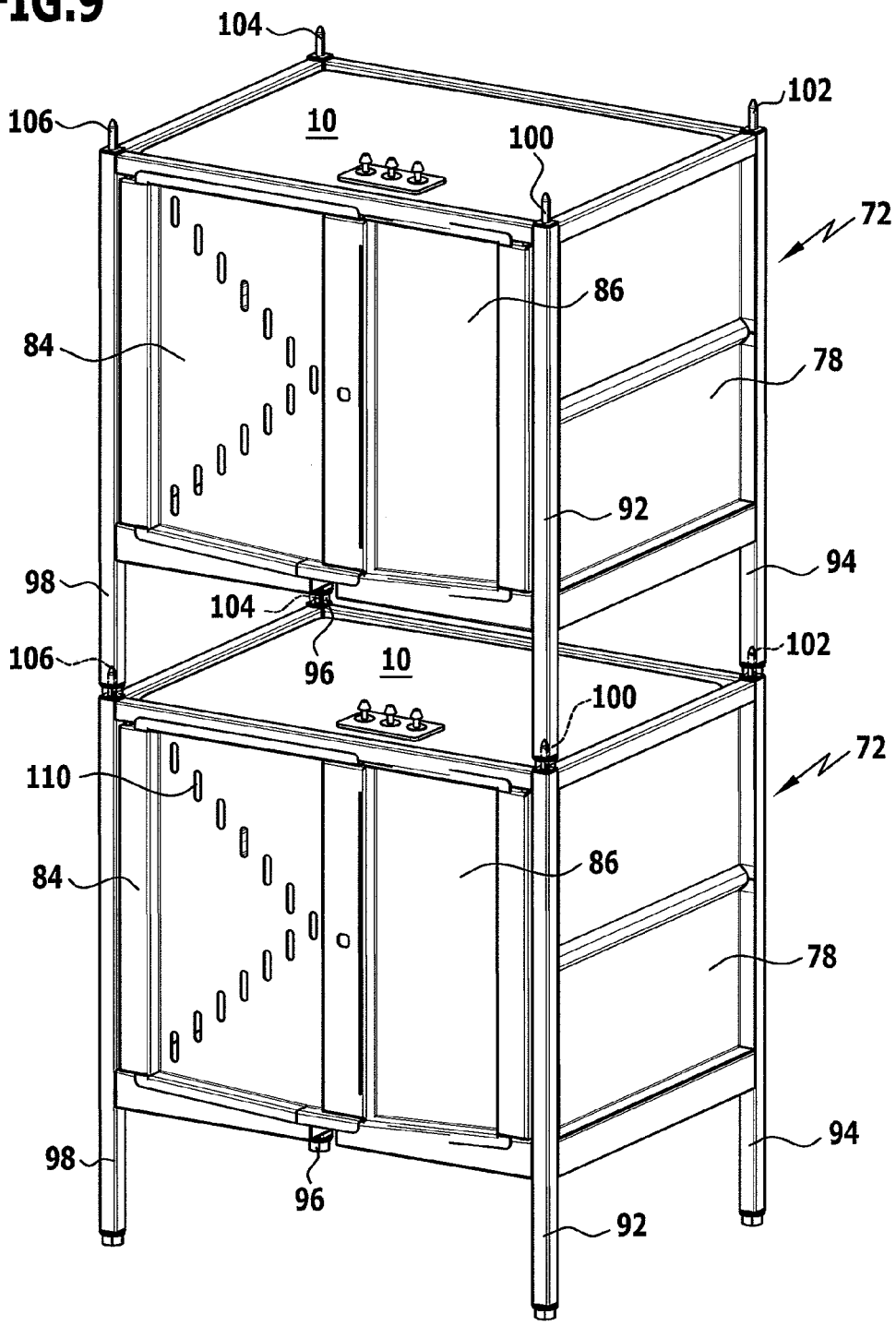
FIG. 9 is a perspective representation of two stacked totes of FIG. 3A.

FIG. 9 finally shows two stacked totes, each being set up with a container 10, the containers 10 being shown in their fully expanded state.

It is readily apparent from FIG. 9 that two or more of the totes 72 may be easily and safely stacked on top of one another and nevertheless provide easy access to the inlet and outlet ports of each of the containers 10 comprised in each one of the stacked totes.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A system comprising a tote and a flexible container which fits into said tote, said tote including a box shaped body with four side faces and a floor, said floor having a cut out in the form of a slot extending from an edge portion of the floor into the interior of the tote, said edge portion being part of an edge of the floor adjacent to a side face of the tote which comprises a door or a flap, wherein the floor of the tote has a slightly slanted configuration in the direction of the cut out which marks the lowest section of the floor, said flexible container having a bottom wall, a top wall and four side walls of a substantial rectangular configuration and made of a flexible plastic sheet material, wherein the container is made of four sheets of flexible plastic material, a first sheet forming the bottom wall, a second sheet forming the top wall and a third and a fourth sheet forming two side walls at opposite sides of the container, and wherein each of the sheets comprise at opposite ends triangular or trapezoid shaped wall parts integrally formed with the sheets, said wall parts being joined together and form the third and fourth side walls of the container, respectively, said container comprising at least a first port, wherein said bottom wall comprises said at least one port in an off-center position, said cut out accommodating said first port at the bottom wall of the container, wherein the door or flap overlaps the edge portion of the floor which accommodates the cut out when the door or flap is in a closed position, wherein said container further comprises a support element attached to the container at said first port, the support element fitting within the cut out, and supporting a portion of the bottom wall of the container, and wherein the support element has an upper surface that is flush with an upper surface of the floor of the tote, when the container is inserted into the tote.

2. The system of claim 1, wherein the cut out in the floor of the tote is designed to accommodate two or more ports.

3. The system of claim 1, wherein the floor of the tote comprises two or more cut out portions to accommodate a multiplicity of ports.

4. The system of claim 1, wherein the first port at the bottom wall of the container is positioned within a distance from an edge of the bottom wall of the container which is half the height of the container or less.

5. The system of claim 4, wherein the distance of the first port from an edge of the bottom wall of the container is about one third of the height of the container or less.

6. The system according to claim 1, wherein the door or flap provided at one side face of the tote extends over substantially the whole length of said side face.

7. The system according to claim 1, wherein the system comprises two or more totes stacked on top of one another.

8. The system of claim 7, wherein the totes comprise at their lower and upper ends co-operating connecting means to fix the stacked totes.

9. The system of claim 1, wherein said supporting element is detachably held on said first port.

10. The system of claim 1, wherein said supporting element is permanently joined to the first port.

11. The system of claim 1, wherein said sheet material forming the walls of the container is made of a multilayer plastic film.

12. The system of claim 11, wherein the multilayer film comprises a first layer of a polyethylene material.

13. The system of claim 11, wherein the multilayer film comprises a gas barrier layer, the gas barrier layer constituting a third layer interposed between a first and a second layer.

14. The system of claim 13, wherein the gas barrier layer is made of an EVOH polymer material.

15. The system of claim 1 comprising a set of a multiplicity of flexible containers, all containers of said set of containers having substantially identically sized bottom walls, but different holding volumes, the first ports of the individual containers of the set of containers being positioned in a substantially identical position of the bottom wall.

16. A system comprising a tote and a flexible container which fits into said tote, said tote including a box shaped body with four side faces and a floor, said floor having a clot out in the form of a slot extending from an edge portion of the floor into the interior of the tote, said edge portion being part of an edge of the floor adjacent to a side face of the tote which comprises a door or a flap, wherein tile floor of the tote has a slightly slanted configuration in the direction of the cut out which marks the lowest section of tile floor, said flexible container having a bottom wail, a top wall and four side walls of a substantial rectangular configuration and made of a flexible plastic sheet material, wherein the container is made of four sheets of flexible plastic material, a first sheet forming the bottom wall, a second sheet forming the top wall and a third and fourth sheet forming two side walls at opposite sides of the container, and wherein each of the sheets comprise at opposite ends triangular or trapezoid shaped wall parts integrally formed with the sheets, said wall parts being joined together and form the third and fourth side walls of the container, respectively, said container comprising at least a first port, wherein said bottom wall comprises said at least one port in an off-center position, said cut out accommodating said first port at the bottom wall of the container, wherein the door or flap overlaps the edge portion of the floor which accommodates the cut out when the door or flap is in a closed position, wherein said container further comprises a support element attached to the container at said first port, the support element fitting within the cut out, and supporting a portion of the bottom wall of the container, and wherein the support element is flush with the edge of the floor of the tote, when the container is inserted into the tote.

17. A system comprising a tote and a flexible container which fits into said tote, the tote including a box shaped body with four side faces and a floor, the floor having a slot cut out from an edge portion of the floor into the interior of the tote, the edge portion being part of an edge of the floor adjacent to a side face of the tote which comprises a door or a flap, wherein the floor of the tote has a slightly slanted configuration in the direction of the slot cut out which marks the lowest section of the floor, the flexible container having a bottom wail, a top wall and four side walls of a substantial rectangular configuration and made of a flexible plastic sheet material; the container comprising at least a first port, wherein the bottom wall comprises the at least one port in an off-center position, the container further comprising a support element attached to the container at the first port, the support element fitting within the slot cut out, and supporting a portion of the bottom wall of the container, wherein the support element has an upper surface that is flush with an upper surface of the floor of the tote, when the container is inserted into the tote;

the slot cut out accommodating the first port at the bottom wall of the container, wherein the door or flap overlaps the edge portion of the floor which accommodates the slot cut out when the door or flap is in a closed position.

* * * * *